United States Patent [19]

Willoughby et al.

[11] 4,218,853

[45] Aug. 26, 1980

[54] ENERGY ABSORBING KEYHOLE SLOTS

[75] Inventors: Robert A. Willoughby; John P. Law; Renno W. Budziak, all of Athens, Pa.

[73] Assignee: Ingersoll-Rand Company, Woodcliff Lake, N.J.

[21] Appl. No.: 964,677

[22] Filed: Nov. 29, 1978

[51] Int. Cl.[2] ..... B24B 55/04

[52] U.S. Cl. ..... 51/269; 83/478; 144/251 R; 74/609; 188/1 C

[58] Field of Search ..... 51/268, 269; 83/545, 83/478, 860; 144/251 R, 252 R; 74/608, 609, 612; 192/129 R; 188/1 C

[56] References Cited

U.S. PATENT DOCUMENTS

| | | | |
|---|---|---|---|
| 3,492,888 | 2/1970 | Nishimura et al. | 188/1 C |
| 3,856,328 | 12/1974 | Koizumi | 188/1 C |
| 3,994,467 | 11/1976 | Pike | 188/1 C |

FOREIGN PATENT DOCUMENTS

| | | | |
|---|---|---|---|
| 2046564 | 3/1972 | Fed. Rep. of Germany | 51/269 |

*Primary Examiner*—Frank T. Yost
*Assistant Examiner*—Roscoe V. Parker, Jr.
*Attorney, Agent, or Firm*—Walter C. Vliet

[57] ABSTRACT

A grinder guard where the mounting is designed to absorb energy without release. The improvement comprising an energy absorbing mounting bolt slot in the guard.

7 Claims, 3 Drawing Figures

ENERGY ABSORBING KEYHOLE SLOTS

BACKGROUND OF THE INVENTION

This invention relates to portable grinders. In the past attempts to design a grinder guard which is effective in retaining the fragments of a broken grinder wheel have experienced varying degrees of success and few have been entirely satisfactory.

At the high rotation speeds of a modern hand held grinder, wherein the speeds often exceed 12,000 rpm, the task becomes extremely difficult for the grinder designer. Due to the high energy to be absorbed, it is extremely difficult to design a guard with sufficient strength to withstand the forces generated and at the same time light enough not to be an unnecessary burden to the operator, a safety related factor in itself. Several materials including high strength steels, aluminum and reinforced plastics have been tried with limited success. In some instances where the guards have been designed to absorb a great deal of energy a problem has existed in the mounting of the guard and guards have been separated from the grinder as mounting bolts have sheared off. This creates a further hazard.

Current safety guard requirements for portable grinders dictate wheel fragment containment must be maintained through a minimum of 180° arc in the direction of the operator and that the guard must remain in protective position after wheel explosion.

Current cup guard configurations for Type 6 and specifically for Type 11 taper wheels, typically do not adequately contain wheel fragments. Wheel containment failures can be primarily attributed to loss of axial containment relative to the grinder arbor axis.

When wheel fragments begin to escape axially, effective peripheral containment through a minimum of 180° of the guard envelope is completely lost. It has also been ascertained that any inside peripheral guard obstructions such as skirt mounting bolt heads or nuts, impede free particle escapement. These skirt mounting bolt heads or nuts additionally act as energy transfer points to the main guard mounting bolts. If the wheel speed at the time of explosion is sufficiently great, enough energy is expended to sheer the bolts under rigid mounting conditions.

The current state of the art for guard mounting provides for either rigid or integral guard mounting, or pinch bolt guard mounting. Both of these mounting configurations have their specific limitations. Rigid or integral guard mounting affords very little energy dissipation during a wheel explosion which normally will result in severe guard distortion and failure. Additionally, if the mounting bolts fail, the resulting guard rotation will leave the operator exposed to wheel fragments. The pinch bolt configuration affords energy dissipation. However, the resulting guard rotation will also leave the operator exposed to exploded wheel fragments.

OBJECT OF THE INVENTION

The object of the invention is to provide an improved wheel fragment containment guard capable of absorbing the fragmented wheel through the minimum required 180° arc.

The object of this invention is further to provide a means of dissipating the energy of an exploding grinder wheel.

A further object is to improve the guard structural integrity and to maintain the initial positioning during wheel explosion.

Yet, a further object of the invention is to provide for an unobstructed wheel fragment escape outside of the 180° protective arc.

These and other objects are obtained in an energy absorbing mounting for bolting on tool guards comprising: a plurality of elongated bolt holes in the mounting portion of the guard; the elongated bolt hole having a maximum dimension approximately equal to the diameter of the mounting bolt; a major dimension greater than the minor dimension; the minor dimension decreases in the direction opposite of movement of the tool guard upon impact so that said minor diameter is progressively deformed by the mounting bolt in response to the impact as an energy absorbing means.

DESCRIPTION OF THE PREFERRED EMBODIMENT

Figure 1:
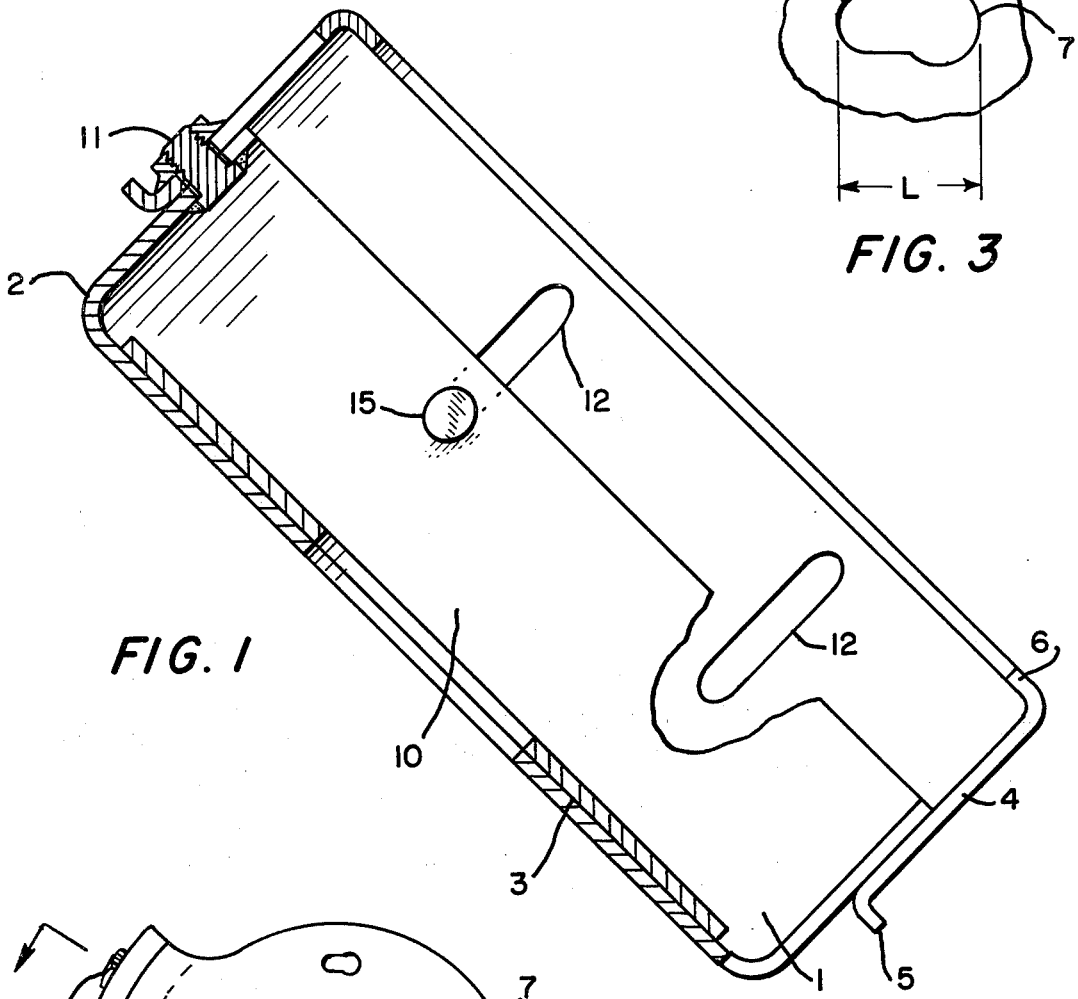
FIG. 1 shows a side elevation cross section partially cut away view of a grinder guard according to this invention taken at Section 1—1 of FIG. 2.

FIG. 1 shows a grinder guard for portable grinding tools designated by reference numeral 1. The guard comprises a relatively fixed cup shaped guard body 2 which is attached to a typical rotary hand tool grinder by means of a flange 3. A moveable portion 4 of the guard which is essentially a cylindrical skirt is shown mounted to the guard body. The skirt is provided with both a reinforcing flange 5 at its upper end and an inward turned retaining lip 6 at its lower end which further serves to strengthen the skirt.

Figure 2:
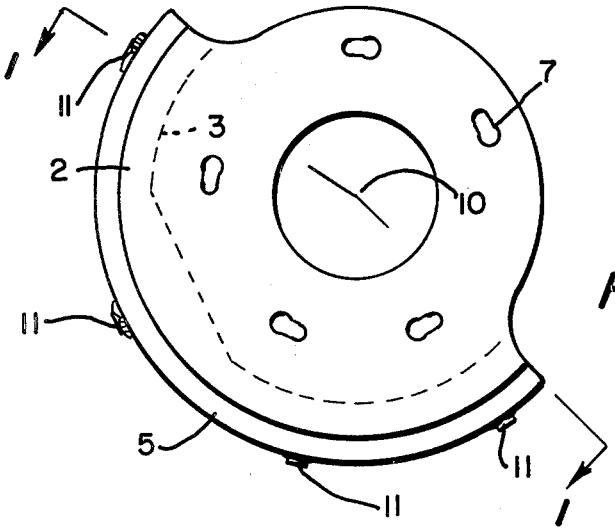
FIG. 2 shows a plan view of the grinder guard.

The mounting flange 3 is rigidly secured to the guard body 2 by welding or other convenient means. As shown in FIG. 2, the flange and guard body are provided with five key hole shaped mounting holes 7, which are radially disposed about the vertical axis or rotating axis 10 of the grinder. Further, as can best be seen on FIG. 2, the guard extends for approximately 180° about its vertical axis 10.

The key hole slots accept mounting bolts not shown, which attach the grinder guard to the grinder. The skirt 4 is also mounted to the guard body 2 by means of 4 flat headed bolts 11. The skirt is provided with 4 vertical elongated holes 12, which allow the skirt to be adjusted vertically relative to the guard body, as shown in FIG. 1. In addition, the guard body is provided with holes 15, which accept the flat head bolts and provide for mounting and relative adjustment between the guard body and skirt. The relative adjustment allows compensation for grinding wheel wear.

Figure 3:
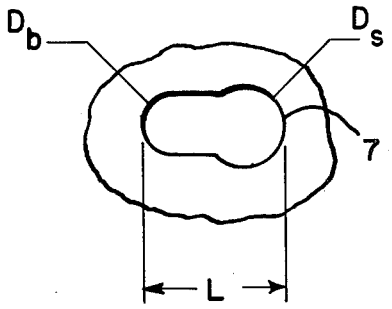
FIG. 3 shows the detail of an energy absorbing mounting bolt slot according to the present invention.

FIG. 3 shows the detail of the energy absorbing mounting bolt slot for a grinder guard equipped to the present invention. The dimensions shown are suitable for a standard ¼-20 UNC-3A hex head cap screw which typically would be used as a mounting bolt for the present guard. The key hole slot is shown with a shank or minor dimension portion $D_s$ of 0.28 inches which freely accepts the normal 0.250 major diameter of the bolt. The key hole has a blade or reduced minor dimension portion $D_b$ of 0.230 inches and a length or major dimension L of 0.41 inches. In the example shown, five mounting bolts would be utilized in the five key holed shaped mounting holes 7. The dimensioning for the key hole slot shown on FIG. 3 was arrived at in the following manner for the embodiment described:

It has been found that a 6 inch by 2 inch type 11 cup wheel rotating at approximately 10,000 rpm possesses approximately 3,940 ft. lbs. of energy which must be dissipated upon explosion of the wheel. Assuming the 180° containment envelope presently required this means that approximately 1,970 ft. lbs. of energy must be absorbed by the guard. By experimentation, we have found that it takes approximately 9,500 lbs. of force to force a $\frac{1}{4}$-20 bolt into a key hole slot having the dimension as shown on FIG. 3, that is, forcing the bolt to deform the metal in the reduced minor diameter D min. section of the key hole. For purposes of the Preferred Embodiment, the bolt was forced through a key hole slot of the dimension shown in a sandwich of approximately 0.050 inch and 0.134 inch thick stainless steel from which the guard and reinforcing flange are manufactured. The bolt was torqued to 14 ft. lbs. accorcing to the specification for torquing the guard bolts. Knowing the force necessary to deform the slot material it is then possible to determine the amount of work done by a couple force turning through an angle of rotation.

In the Embodiment shown on FIG. 2 the five key hole slots are on a 1.5 inch radius from the center of guard and spindle rotation. With the major dimension L of 0.41 inches this allows for approximately 0.087 radians of rotation. The energy absorbed by each bolt may be computed form the equation $U=M\theta$ where U is the energy absorbed in ft. lbs.; M is the torque of the couple in ft. lbs. and $\theta$ is the angular rotation in radians. With 9,500 lbs. of force required to deform the slot at 1.75 inch radius and 0.087 radians of rotation, $U=9500$ $(1.75/12)\ 0.087=120$ ft. lbs. of energy per bolt. For five bolts this amounts to 600 ft. lbs. of energy or nearly $\frac{1}{3}$ of the the total energy to be absorbed. This leaves approximately 1,310 ft. lbs. of energy remaining to be absorbed by deformation of the grinder guard itself. This is, of course, a substantial reduction and has resulted in a significant improvement in the ability of the grinder guard to retain the disbursed fragments of the grinder wheel without excessive deformation.

If additional energy absorption is required, the number of bolts may be increased or the length of the key hole slot elongated to allow for a greater amount of rotation. The extent of rotation, of course, is limited by the amount of rotation which is acceptable for the grinder guard during energy absorption. In the present example approximately $\frac{1}{3}$ of the total contained energy is absorbed by the key hole slots of the present invention.

It should be obvious to one skilled in the art who will now understand the present invention that the configuration of the key hole slot may be varied substantially to accomplish the desired degree of energy absorption. Where increased energy absorption is desirable with time, a tear drop shaped slot may be utilized. Where high initial energy absorption is desired, the reduced cross section of the key hole slot may be minimized to the point of metal tear out. Total energy is, of course, a function of the amount of rotation allowed by the major dimension. Where the arc of rotation is significant, for example, if a substantial degree of rotation is desirable for the key hole slots shown in the flange, the key hole slot 7 may be accurately formed in the reduced cross section portion to follow the bolt during energy absorption.

It should also be obvious to one skilled in the art that the invention is applicable to linear absorption of energy as for example in a sheet metal fastener or track stop mount.

It should also be obvious to one skilled in the art, that numerous modifications of this invention are possible and that we do not wish to be limited in the scope of the invention except as claimed.

I claim:

1. An impact energy absorbing mounting for a bolted on guard device comprising:

means defining an elongated bolt hole in the mounting portion of said device for receiving a mounting bolt which secures the guard device in position;

said elongated bolt hole having a maximum minor dimension approximately equal to the diameter of said mounting bolt and a major dimension greater than the minor dimension; and said minor dimension being decreased in the direction opposite of movement of said device upon impact so that said minor dimension is progressively deformed as an energy absorbing means by said mounting bolt in response to an impact on said guard device.

2. The energy absorbing mounting of claim 1 wherein:

said guard device is a tool guard for a rotary grinder and said elongated bolt hole further comprises a plurality of bolt holes arranged in a radial pattern about the rotary axis of said rotary grinder for absorbing both the radial outward and rotational forces imparted to said guard device in the event of grinder wheel failure.

3. The energy absorbing mounting of claim 2 wherein:

said elongated bolt holes are key hole shaped.

4. The energy absorbing mounting of claim 2 wherein:

said elongated bolt holes are tear drop shaped.

5. The energy absorbing mounting of claim 2 wherein:

said guard is adapted for a portable power tool and made of a deformable non-brittle material.

6. The energy absorbing mounting of claim 5 wherein:

said material is made of stainless steel.

7. The energy absorbing mounting of claim 2 wherein:

the maximum minor dimension is at least 10% greater than the minimum minor dimension of the key hole slot.

* * * * *